US006862985B2

(12) United States Patent
Beger et al.

(10) Patent No.: US 6,862,985 B2
(45) Date of Patent: Mar. 8, 2005

(54) GUIDING DEVICE FOR METAL-SHEET PRINTING MACHINES AND METAL-SHEET PAINTING MACHINES

(75) Inventors: Hans Beger, Walddorfhäslach (DE); Harald Klotz, Maulbronn-Schmie (DE); Otto Kunzi, Remseck (DE)

(73) Assignee: Bauer + Kunzi Gesellschaft fur Drucktechnik mbH, Ditzingen (DE)

( * ) Notice: Subject to any disclaimer, the term of this patent is extended or adjusted under 35 U.S.C. 154(b) by 0 days.

(21) Appl. No.: 10/443,132

(22) Filed: May 22, 2003

(65) Prior Publication Data

US 2004/0065218 A1 Apr. 8, 2004

Related U.S. Application Data

(63) Continuation-in-part of application No. PCT/EP01/13494, filed on Nov. 21, 2001.

(30) Foreign Application Priority Data

Nov. 22, 2000 (DE) ..... 100 58 176
Oct. 2, 2001 (DE) ..... 201 16 178

(51) Int. Cl.[7] ..... B41F 27/10; B41F 7/16
(52) U.S. Cl. ..... 101/246; 101/410; 271/277
(58) Field of Search ..... 101/232, 246, 101/408, 409, 410; 271/275, 277

(56) References Cited

U.S. PATENT DOCUMENTS 4,815,379 A * 3/1989 Becker et al. ..... 101/246

FOREIGN PATENT DOCUMENTS

| | | | |
|---|---|---|---|
| DE | 689632 | | 3/1940 |
| DE | 725705 | | 9/1942 |
| DE | 43 38 947 | A1 | 5/1995 |
| DE | 44 43 493 | A1 | 6/1996 |
| EP | 0 185 965 | B1 | 3/1989 |
| EP | 0 752 310 | B1 | 1/1997 |
| GB | 741153 | | 11/1955 |
| GB | 2051746 | * | 1/1981 |

* cited by examiner

*Primary Examiner*—Stephen R. Funk
(74) *Attorney, Agent, or Firm*—Foley & Lardner LLP

(57) ABSTRACT

The invention relates to a guiding device for metal sheet printing machines and metal sheet painting machines, which have at least two printing cylinders and a transfer drum situated therebetween. The guiding device is arranged on said transfer drum and, to be precise, is located close to the imaginary cylindrical outer surface of the transfer drum. The guiding device comprises at least one guiding element with an outwardly turned bearing surface for supporting the rear edge of the metal sheets. The guiding element is pivotally mounted by means of a swivel bearing whose pivotal axis is parallel to the axis of the transfer drum. The guiding element is coupled to a pivot drive by means of which its bearing surface can be adjusted to different pivoting angles (β) with regard to the tangent to the imaginary cylindrical outer surface of the transfer drum. This pivoting angle (β) is larger at the rotating position of the transfer drum at which the rear edge of the metal sheets rest against the guiding element, and is smaller at the rotating position at which the rear edge of the metal sheets leave the guiding element.

18 Claims, 4 Drawing Sheets

Fig.

Fig. 2
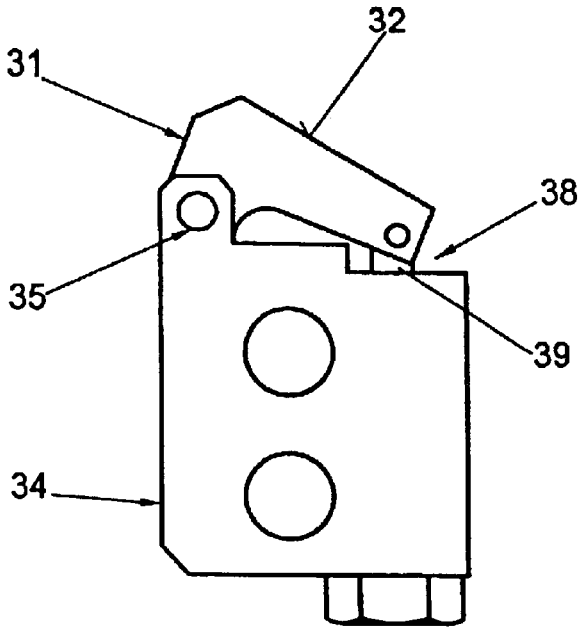
Fig. 3
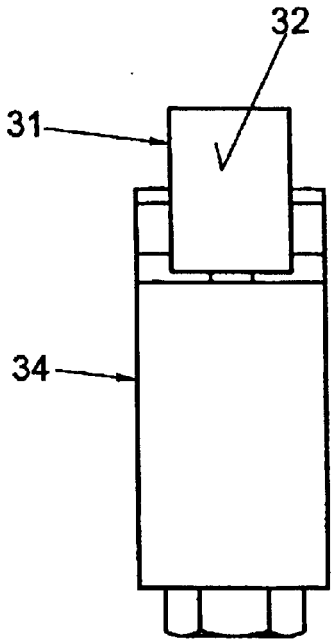
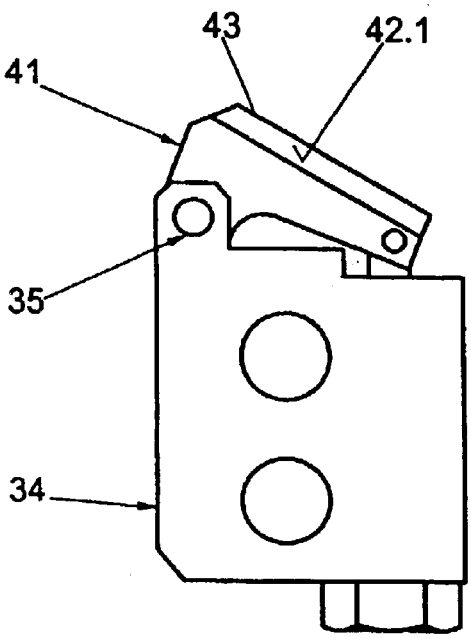
Fig. 4
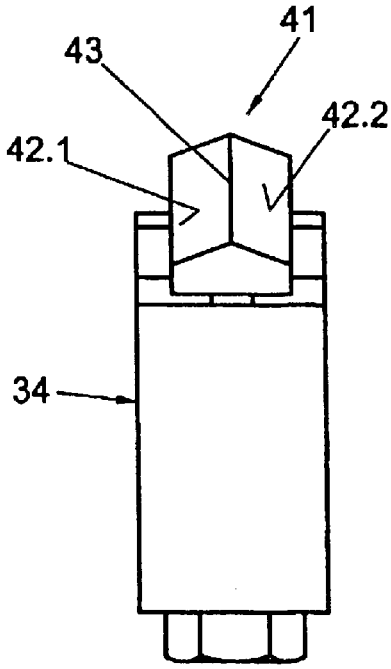
Fig. 5

GUIDING DEVICE FOR METAL-SHEET PRINTING MACHINES AND METAL-SHEET PAINTING MACHINES

This application is a continuation-in-part application of pending PCT application PCT/EP01/13494, filed on Nov. 21, 2001, and published in German on May 30, 2002, as WO 02/42076. The Applicants hereby claim the benefit under 35 U.S.C. 120 of this PCT application, and under 35 U.S.C. 119 of German application 100 58 176.5 filed Nov. 22, 2000, and of German application 201 16 178.8 filed Oct. 2, 2001. The entire contents of this PCT application and these German applications are incorporated herein by reference.

BACKGROUND OF THE INVENTION

Metal-sheet printing machines and metal-sheet painting machines are used for printing and painting sheets of metal, from which cans for packing purposes, lids for these cans or for glasses, closures for bottles or similar articles made of thin sheet are produced. These sheets of metal are referred to as metal sheets below. The printing machines and painting machines are also used for printing and/or painting sheets of other materials, for example of plastics material.

In these machines a number of printing cylinders and transfer drums follow in succession. In the case of many machines the axes of these cylinders and drums are situated approximately at the same level. In the case of other machines the axes of the transfer drums are situated at a lower level than those of the printing cylinders.

The printing cylinders have a substantially closed cylindrical surface. The transfer drums, on the other hand, preferably comprise a tubular drum core of smaller diameter on which are arranged some components which rotate with the drum core. The outermost cylindrical path of movement of these components defines an imaginary cylindrical generated face of the transfer drums, to which part of the remarks set out hereinafter relates.

In the case of both the printing cylinders and the transfer drums, grippers which grip the front edge of the metal sheets to be printed or painted and which entrain them are arranged at a specified peripheral point. Grippers of this type are not provided for the rear edge of the metal sheets.

During their passage through the printing machine the metal sheets are transferred from the printing cylinder to the transfer drum and from the latter to the printing cylinder. In this case they are gripped at their front edge portion by the associated grippers and are passed on from one transfer station to the next one. During this the metal sheets change their curvature.

During the passage with the printing cylinder, which should in fact be referred to as a counter-printing cylinder, the metal sheets rest with their rear side on the printing cylinder. In this case the metal sheets are guided by being guided through the narrow gap between the printing cylinder and a blanket cylinder which transfers the print image with a specified coloration onto the front side—facing it—of the metal sheets.

During the passage with the transfer drum the metal sheets are guided on their rear side by guide strips which are arranged at a certain distance from the imaginary generated face of the transfer drum. These guide strips extend over a peripheral region of the transfer drum which is smaller than the peripheral region between the first and the second transfer station of the transfer drum.

During the transfer of the metal sheets from the transfer drum to the immediately following printer cylinder, after a specified distance, of travel, of the metal sheets their rear longitudinal portion no longer rests against the guide strips on the one hand and does not yet rest against the printing cylinder on the other hand. This leads to the metal sheets becoming unstable and tending to vibrate outside their clamped front edge area under the action of internal and external forces, such as for example elasticity and forces of inertia. These phenomena occur even in the case of printing machines, the axes of which are situated at the same level.

In order at least to reduce these vibrations it is known for guide elements to be applied to the transfer drum, the guide elements being arranged in the end region of the metal sheet in such a way that the rear edge of the metal sheet can rest against them. For this purpose these guide elements have an abutment face which is at a specific fixed angle of inclination with respect to the tangent of the generated face of the transfer drum.

Since the guide element moves away from the metal sheet on its circular path of movement, the angle of inclination between its abutment face and the rear end potion of the metal sheets changes. During the transfer of the metal sheets from the transfer drum to the immediately following printing cylinder the vibrations occurring in the metal sheet and the instability of its rear portion therefore have the result that not only the end edge of the metal sheets but, also, their entire end portion and with it the end portion of the printed area rest against the abutment face of the guide element, and as a result the print image is blurred.

In the case of printing machines with a vertical offset of the axes of the printing cylinders and the transfer drums, this error can occur to an increased degree. In certain cases this blurring of the print image makes the metal sheets unusable.

BRIEF SUMMARY OF THE INVENTION

The object of the invention is to provide a guide device for metal-sheet printing machines and metal-sheet painting machines in which the blurring of the paint image in the rear end area of the metal sheets is at least reduced, if not entirely prevented. This object is attained by a guide device for metal-sheet printing machines and metal-sheet painting machines, comprising: at least two printing cylinders, which are arranged adjacent to one another at a mutual distance and the axes of which are orientated parallel to one another; a transfer drum, the axis of which is orientated at least approximately parallel to the axis of the printing cylinders, is present between two respective mutually adjacent printing cylinders in each case; guide strips provided below the transfer drum, which are at an adjustable distance from an imaginarily generated face of the transfer drum, and which extend over a peripheral region of the transfer drum, which is smaller than the peripheral region which extends from the first transfer station of the metal sheets between the first print cylinder and the transfer drum as far as the second transfer station of the metal sheets between the transfer drum and the second print cylinder; at least one guide element provided at a specific peripheral point on the transfer drum and arranged in an end region of the metal sheets, which comprises an abutment face for the metal sheets, which is directed outwards and which has a pre-determined angle of inclination with respect to the tangent of the imaginarily generated face of the transfer drum, wherein: the guide element is mounted so as to be pivotable by means of a pivot bearing with a pivot axis orientated parallel to the axis of the transfer drum, a pivot drive is provided, by means of which the angle of inclination of the abutment face of the guide element can be altered with respect to the tangent of the imaginarily generated face of the transfer drum.

By virtue of the fact that the guide element is mounted so as to be pivotable by means of a pivot bearing with a pivot axis orientated parallel to the axis of the transfer drum and the inclination of its abutment face can be varied by means of a pivot drive, the abutment face can be adjusted more satisfactorily to the angular position of the end portion of the metal sheets, so that only the rear edge of the metal sheets rests against the guide face, but no longer their rear end portion. As a result, the risk of blurring of the print image at the rear end portion is at least considerably reduced, if not absolutely eliminated.

With the design of the guide device, wherein the angle of inclination, β, is at least within a range of approximately 75° to 5°, a particularly advantageous angular range for the pivoting movement of the abutment face is provided.

With a design of the guide device, wherein the abutment face of the guide element is subdivided into two portions, the abutment of the metal sheets against the guide element in the case of a roof-shaped arrangement of the portions of the face is limited to the ridge edge and in the case of a dovetailed arrangement of the portions of the face is limited to the two longitudinal edges of the guide element situated on the outside.

In a similar manner, with a design of the guide device, wherein the abutment face of the guide-element is oriented at an inclination in the axial direction the abutment of the metal sheets against the guide element is limited to the lateral longitudinal edges of the latter.

A design of the guide device, wherein when two guide elements are present, their abutment face is inclined in the axial direction and the axial inclination of the two abutment faces is orientated in opposite directions, ensures that even in the case of relatively wide metal sheets their rear edge rests only against one respective lateral edge of the guide elements in each case, even if the metal sheets are curved in a concave or convex manner in their transverse direction under the action of their inherent weight and/or their forces of inertia.

As a result of a design of the guide device, wherein, in the case of two or more guide elements, at least part of them are made adjustable in the axial direction, the guide elements can easily be set to different widths of the metal sheets.

With a design of the guide device, wherein the existing guide elements and their associated pivot drive are arranged on a common support, the pivotable guide elements can be set in the peripheral direction to different lengths of the metals sheets, in which case their setting in the peripheral direction is limited as a rule to the peripheral position of the grippers which grip the metal sheets at the front edge portion.

As a result of a design of the guide device, wherein the pivot drive is adjustable to two end positions, the pivot drive for the guide element can be designed in a relatively simple manner. This applies in particular to one of the further developments of the guide devices, wherein the pivot drive has a pneumatic or hydraulic piston drive or electromagnet.

With a design of the guide device, wherein the pivot drive is continuously adjustable within a pre-determined pivoting range, the adaptation of the inclination of the abutment face can be set still more satisfactorily to the movement ratios and resilient deformation of the rear longitudinal portion of the metal sheets. This applies in particular to the further developments, wherein the pivot drive has a crank drive or a cam drive or a spindle drive, and/or wherein the pivot drive is formed by a controllable electric motor or comprises such a motor. A further optimization of the setting of the abutment face of the guide element can be achieved with a design of the guide device, wherein the pivot angle of the guide element is adjustable as a function of at least part of its rotational path between the two peripheral paths.

With a design of the guide device, wherein the guide element itself is produced from a vibration-damping material or at least is provided with a vibration-damping coating, the vibrations of the metal sheets are reduced at least in the region of their rear edge. This has a steadying effect upon the metal sheets as a whole and likewise contributes to the risk of blurring of the print image at the rear end portion being at least considerably reduced, if not being absolutely eliminated.

With a design of the guide device, wherein the guide element is provided in the region of its abutment face with a wear-resistant layer, there is at least a substantial reduction in an abrasive action by the rear edge of the metal sheets on the abutment face of the guide element, which can arise as a result of the fact that, on account of the geometrical ratios and the properties of the material, the rear edge of the metal sheets moves along the abutment face of the guide elements, and as a result of the fact that the metal sheets have a sharp burr as a rule on account of separation from a coil and the said burr can cause heavy wear on the abutment face of the guide element. As a result of a design of the guide device, wherein the guide element is provided in the region of its abutment face with a wear-resistant layer, abrasive action on the abutment face is considerably reduced, in particular on those guide elements which are either themselves produced from a vibration-damping material or the guide element(s) of which are provided with a vibration-damping coating.

As a result of a design of the guide device, wherein the vibration-damping part of the guide element or the vibration-damping layer of the guide element consists of plastics material or of solid rubber or of cellular rubber with open and/or closed pores, a particularly satisfactory vibration-damping action is achieved. As a result of a design of the guide device, wherein the wear-resistant layer consists of a hard metal or of an oxide-ceramic material or of silicate glass, the wear of the guide element is reduced to a particularly pronounced degree.

BRIEF DESCRIPTION OF THE DRAWINGS

The invention is explained in greater detail below with reference to embodiments illustrated in the drawing, in which

FIGS. 2 and 3 are a side view and a front view respectively of a first embodiment of the guide device with a guide element;

FIGS. 4 and 5 are a side view and a front view respectively of a second embodiment of the guide device with a guide element;

DETAILED DESCRIPTION OF PREFERRED EMBODIMENTS

Figure 1:
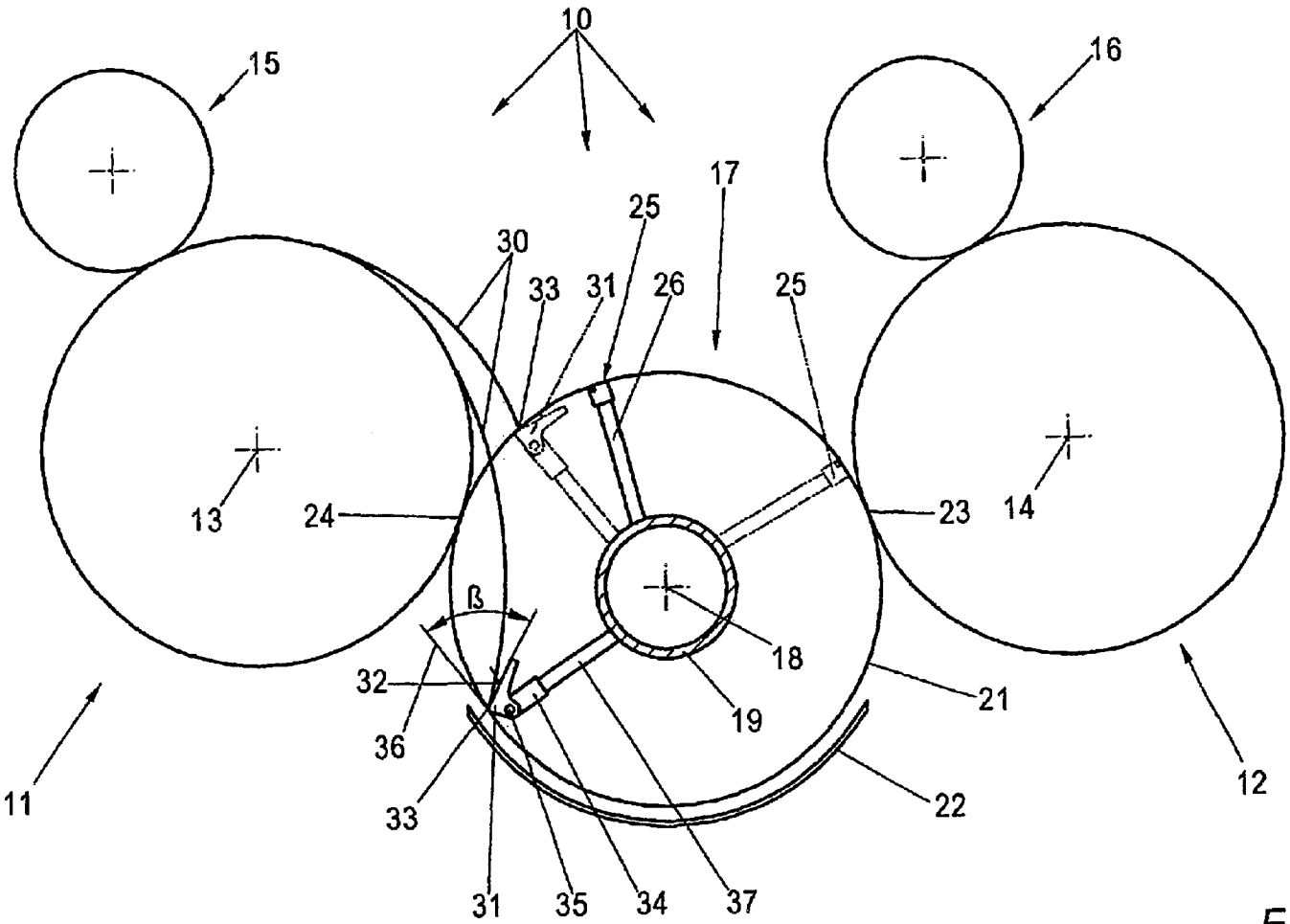
FIG. 1 is a section—illustrated diagrammatically—of part of a metal-sheet printing machine with a guide device for the rear edge of the metal sheets.

FIG. 1 shows, in a highly diagrammatic illustration, part of the metal-sheet printing machine 10, which is referred to hereinafter in brief as the printing machine 10. This part of the printing machine has two so-called printing cylinders 11 and 12 which in accordance with their function are counter-printing cylinders. The axis 13 of the printing cylinder 11 and the axis 14 of the printing cylinder 12 are oriented parallel to each other and are situated at the same level. Each of the printing cylinders 11 and 12 co-operates with one blanket cylinder 15 and 16 respectively in each case, from which the print image is transferred in a specific coloration to the metal sheets which are passed between the printing cylinder and the associated blanket cylinder. For this purpose the printing cylinders 11 and 12 have gripping means, not shown, which at a transfer station, likewise not shown, grip the supplied metal sheets at their front edge and entrain them to the next transfer station.

A transfer drum 17, the axis 18 of which is orientated at least approximately parallel to the axes 13 and 14, is provided between the two mutually adjacent printing cylinders 11 and 12. The axis 18 of the transfer drum 17 is situated below the axes 13 and 14 by a pre-determined amount.

In contrast to the printing cylinders 11 and 12 with a closed cylindrical face, the transfer drum 17 has only a tubular core 19 which is bounded at a pre-determined radial distance by an imaginary cylindrical generated face 21. Apart from a few components which are arranged on the outside of the drum core 19, the space between the drum core 19 and the imaginary generated face 21 is empty.

Guide strips 22, which are at a pre-determined distance which can be adjusted from the imaginary generated face 21 of the transfer drum 17, are arranged below the transfer drum 17. The guide strips 22 extend over a peripheral region of the transfer drum 17, which, peripheral region, is smaller than the peripheral region which extends from the first transfer station 23 to the second transfer station 24 of the metal sheets, of which the first transfer station 23 is situated at the imaginary contact point between the printing cylinder 12 and the transfer drum 17 and of which the second transfer station 24 is situated at the imaginary contact point between the transfer drum 17 and the second printing cylinder 11.

The transfer drum 17 is provided with a plurality of gripping means 25 which are arranged on a common support 26 which is rigidly connected to the drum core 19. The gripping means 25 are arranged in the vicinity of the imaginary generated face 21 of the transfer drum 17 at a peripheral point which is co-ordinated with the peripheral point of the gripping means on the printing cylinders 11 and 12.

During their passage through the printing machine the metal sheets 30 are transferred from the printing cylinder 12 to the transfer drum 17 and from the latter to the printing cylinder 11. In this case, they are gripped by the associated gripping means at their front edge portion and are conveyed from one transfer station on to the next one. During this, the metal sheets 30 change their curvature in part. This has the result that outside their clamped initial area the metal sheets 30 have the tendency to perform self-movements under the action of internal and external forces, such as for example elasticity and forces of inertia. In order to intercept these self-movements at least in part, guide elements 31 are arranged on the transfer drum 17. The said guide elements 31 have an abutment face 32 against which the rear edge 33 of the metal sheets 30 can rest and it is guided by it. The guide elements 31 are arranged on one respective retaining means 34 in each case. They are mounted on the latter so as to be pivotable by means of a pivot bearing 35 about a pivot axis which is orientated parallel to the axis 18 of the transfer drum 17. The guide elements 31 are coupled to a pivot drive (not shown in FIG. 1) by means of which it is possible to alter the angle of inclination β of the abutment face 32 with respect to the tangent 36 of the generated face 21 of the transfer drum 17.

The size range of the angle of inclination β is between 75° and 5°. As may be seen in FIG. 1, the pivot angle β has a greater angular figure in the region of that point of the rotational movement of the guide element 31 at which the rear edge 33 of the metal sheets 30 rests against the guide element 31 during the change in their curvature, and a smaller angular figure in the region of that point of the rotational movement of the guide element 31 at which the rear edge 33 of the metal sheets 30 is released from the guide element 31 again. At the first-named point the guide element 31 and the parts connected to it are illustrated with continuous lines. At the last-named point the guide element 31 and the parts connected to it are illustrated with dash-dot lines. The gripping means 25 and the parts connected to them are illustrated in the same manner.

The retaining means 34 for the guide element 31 is arranged on a support 37 which is connected to the drum core 19 in such a way that the retaining means 34 can be pivoted on an arcuate path of movement about the axis 18 of the transfer drum 17 and can be set to a specified peripheral position by means of a setting device. The said peripheral point is set in accordance with the length of the metal sheets 30 and relates to a fixed peripheral point on the transfer drum 17, which is pre-determined by the gripping means of the transfer drum 17.

The retaining means 34, on which the guide element 31 is mounted so as to be pivotable by means of the pivot bearing 35, may be seen in greater detail in FIGS. 2 and 3. The guide element 31 is designed in the form of a strip. It has a pre-determined length. Its dimensions are such that the rear edge 33 of the metal sheets 30 can rest against it even if the metal sheets are of different length and/or of different elasticity.

The pivot bearing 35 is arranged in the vicinity of one end of the guide element 31. A pivot drive 38 is coupled in the vicinity of the other end. A pivot drive in the form of a pneumatic or hydraulic piston drive is illustrated, the cylinder of which is housed in the retaining means 34 and is connected in an articulated manner thereto and the piston rod 39 of which is coupled in an articulated manner to the guide element 31.

The pivot drive 38 has two end positions, of which one pivot position with the larger pivot angle β is illustrated with continuous lines and the pivot position with the smaller pivot angle β is illustrated with dash-dot lines. Instead of an hydraulic or pneumatic piston drive, a drive is also possible in the form of an electromagnet, which then likewise has two end positions.

The guide element 31 is set to the larger pivot angle β in an area of the rotational movement of the transfer drum 17 which is situated a sufficient distance in front of that peripheral point at which the rear edge 33 of the metal sheets 30 rests against the guide element 31. The position of this peripheral point depends upon a number of factors, in particular upon the length of the metal sheets 30 by which the change in the curvature in the rear longitudinal portion of the metal sheets 30 is also determined. The lifting of the rear edge 33 of the metal sheets 30 from the guide strips 22 and the abutment against the guide element 31 are caused by this change in the curvature of the metal sheets 30.

The guide element 31 is set to the smaller pivot angle β in an area of the rotational movement of the transfer drum 17 which is situated between the two peripheral points at which the rear edge 33 of the metal sheets 30 rests against the guide element 31 and at which the rear edge 33 of the metal sheets 30 is released from the guide element 31 again. Since the last-named peripheral point depends to a very great extent upon the length and the physical properties of the metal sheets, it has to be determined empirically.

In the following embodiments the assumption is to be made that components and sub-assemblies not explained separately are the same or at least similar to those of the components and sub-assemblies described above.

In the case of the embodiment which may be seen in FIG. 4 and FIG. 5, a guide element, the abutment face 42 of which is formed by two portions 42.1 and 42.2 which are arranged in the form of a roof and are attached to each other at the ridge edge 43, are mounted on the retaining means so as to be pivotable by means of the pivot bearing 35. The two portions 42.1 and 42.2 of the face have an opposite inclination in the axial direction with respect to a line parallel to the axis of the pivot bearing 35, which is preferably greater than that axial inclination which the metal sheets 30 display on both sides of the ridge edge 43 if they bulge in a resiliently convex manner in the transverse direction as a result of this abutment against the ridge edge 43. In the event that two guide elements 41 are arranged adjacent to each other at a mutual axial distance, then depending upon the width of the metal sheets 30 and their resilience their bulging can also be concave. In this case the axial inclination of the two portions 42.1 and 42.2 of the face can be greater than that of the metal sheets 30 in the region of their abutment point on the edge ridge 43 of the two guide elements 41. It can also, however, be smaller than that of the metal sheets 30. Their rear edge 33 then rests against the outer edge of the associated portion 42.1 or 42.2 of the face.

Figure 6:
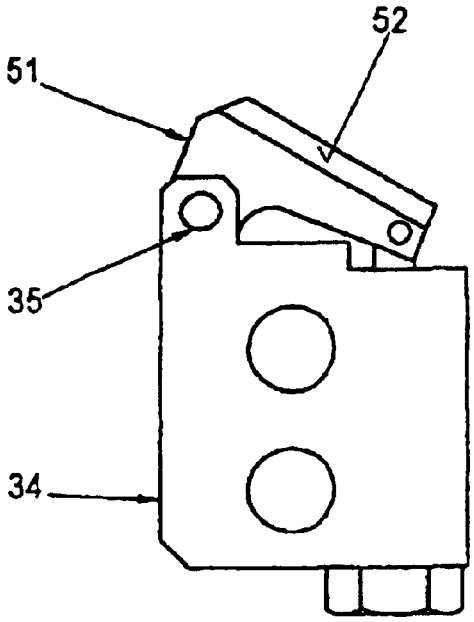
FIGS. 6 and 7 are a side view and a front view respectively of a second [sic] embodiment of the guide device with a guide element.
Figure 7:
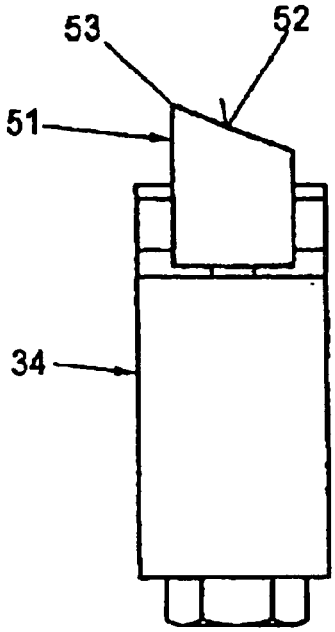
Figure 7:
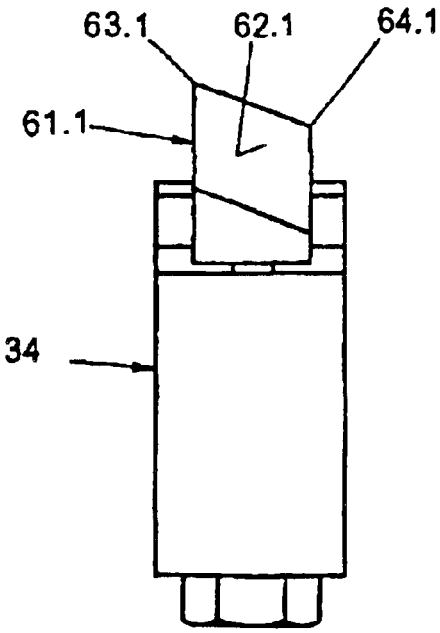

In the case of the embodiment visible in FIGS. 6 and 7, the abutment face 52 on the guide element 51 is inclined as a whole in the axial direction. This has the effect that the rear edge of the metal sheets does not rest on the entire abutment face 52 but only on the projecting longitudinal edge 53 of the guide element 51.

Figure 8:
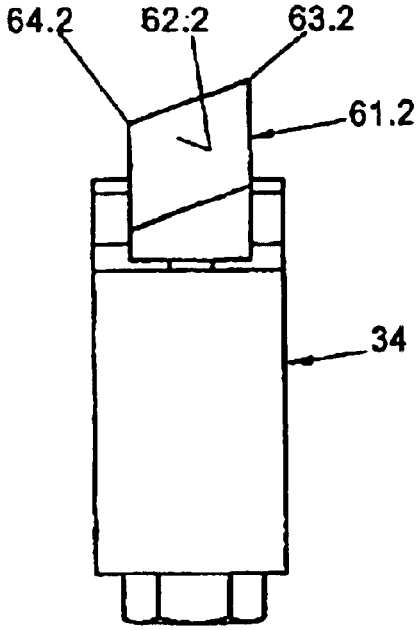
FIG. 8 is a front view of a fourth embodiment of the guide device with two guide elements.

A pair of guide elements, which are designated as guide element 61.1 and 61.2 for better differentiation, may be seen in FIG. 8. The said two guide elements 61.1 and 61.2 are arranged jointly on a support part, not shown, at a predetermined mutual axial distance. They are connected to the support part in such a way that they can be displaced in the axial direction and can be fixed at a specified position.

The guide elements 61.1 and 61.2 differ from each other insofar as their abutment faces 62.1 and 62.2 respectively are inclined in opposite directions in the axial direction. The inclination of the abutment faces 62.1 and 62.2 in the axial direction is advantageously selected to be smaller or larger than the axial inclination of the portions of the facts of the metal sheets 30 which rest against the guide elements 61.1 and 61.2. This has the result that the rear edge of the metal sheets rests either only against the longitudinal edge 63.1 and 63.2 situated at a higher level or only against the longitudinal edge 64.1 and 64.2 and situated at a lower level.

It may be advantageous, instead of the pivot drive described and having two end positions, to use those pivot drives which permit a constant change in the pivot angle β of the abutment face 32 of the guide elements 31. For this purpose, pivot drives with a crank drive, a cam drive or a spindle drive are possible. This pivot drive can comprise a controllable electric motor in order to be able to adapt the pivoting movement to the requirements of different metal sheets. For this purpose, a stepping motor, a servo motor or a linear motor is possible. In addition to their use as an indirect drive these motors can also be used for a direct drive of the guide elements 32, namely with or without intermediate gears.

If a continuously displaceable pivot drive is used, for example with a stepping motor, the pivot angle β of the guide element can be set substantially as a function of its rotational path, in particular in the area of the rotational path between the point at which the rear edge of the metal sheets rests against the guide element and the point at which the rear edge of the metal sheets is released from the guide element.

Vibrations are caused in the metal sheets 30 just by the change in the curvature of the metal sheets 30 which is repeated during the passage through the printing machine. In addition, during the transfer from the transfer drum 17 to the printing cylinder 11, the metal sheets 30 are released from the guide strips 22 and their rear edge 33 strikes the abutment face 32 of the guide elements 31 at a specific speed of impact, and this likewise produces vibrations in the metal sheets 30 or can reinforce vibrations already existing. Since these vibrations have an adverse effect upon a trouble-free passage of the metal sheets 30 through the printing machine, it is advantageous to produce the guide elements 31 entirely from a vibration-damping material. In particular, various plastics materials are suitable for this purpose.

Figure 9:
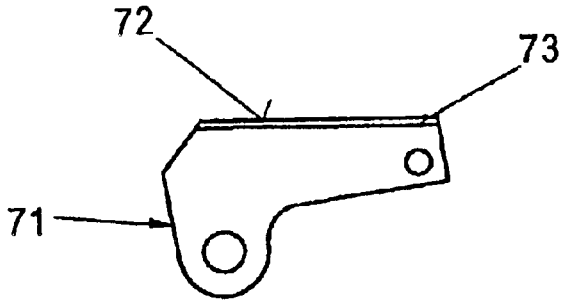
FIG. 9 is a side view of a modified guide element.

Since the metal sheets 30 are cut off from a coil as a rule, a burr occurs at the front edge and the rear edge. The burr of the rear edge has an abrasive effect upon the abutment face of the guide elements. In the case of the guide element 71 visible in FIG. 9, the material of which does not itself have the desired wear resistance, a wear-resistant layer 73 is therefore applied in the region of the abutment face 72.

Figure 10:
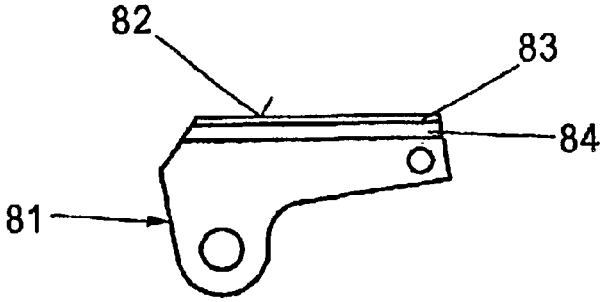
FIG. 10 is a side view of a further modified guide element.
Figure 11:
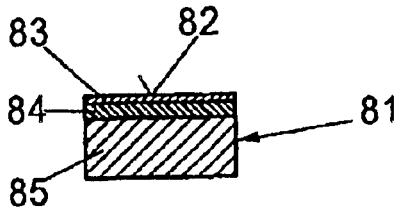
FIG. 11 is a cross-section—shown enlarged—of the guide element according to FIG. 10.

An additionally modified guide element 81 is shown in FIGS. 10 and 11. A layer 83 of a wear-resistant material is present in the region of its abutment face 82. A second layer 84 of a vibration-damping material is present under that. The remaining part 85 of the guide element 81 is produced from a conventional material, for example from metal.

In the case of the guide elements 71 and 81 the nature of the connexion between the guide elements and the layer or layers applied thereto and where appropriate the layers between themselves is dependent upon the materials of the parts joined together. This also applies to additives which are possibly used in this case.

| | |
|---|---|
| 10 | metal-sheet printing machine |
| 11 | printing cylinder |
| 12 | printing cylinder |
| 13 | axis |
| 14 | axis |
| 15 | blanket cylinder |
| 16 | blanket cylinder |
| 17 | transfer drum |
| 18 | axis |
| 19 | drum core |
| 21 | generated face |
| 22 | guide strips |

-continued

| | |
|---|---|
| 23 | transfer station |
| 24 | transfer station |
| 25 | gripping means |
| 26 | support |
| 30 | metal sheets |
| 31 | guide element |
| 32 | abutment face |
| 33 | rear edge |
| 34 | retaining means |
| 35 | pivot bearing |
| 36 | tangent |
| 37 | support |
| 38 | pivot drive |
| 39 | piston rod |
| 41 | guide element |
| 42 | abutment face |
| 42.1 | portion of face |
| 42.2 | portion of face |
| 43 | ridge edge |
| 51 | guide element |
| 52 | abutment face |
| 53 | longitudinal edge |
| 61 | guide element |
| 62 | abutment face |
| 63 | longitudinal edge |
| 64 | longitudinal edge |
| 71 | guide element |
| 72 | abutment face |
| 73 | layer (wear-resistant) |
| 81 | guide element |
| 82 | abutment face |
| 83 | layer (wear-resistant) |
| 84 | layer (vibration-damping) |
| 85 | remaining part |

What is claimed is:

1. A guide device for metal-sheet printing machines and metal-sheet painting machines, comprising:

at least two printing cylinders, which are arranged adjacent to one another at a mutual distance and the axes of which are orientated parallel to one another;

a transfer drum, the axis of which is orientated at least approximately parallel to the axis of the printing cylinders, is present between two respective mutually adjacent printing cylinders in each case;

guide strips provided below the transfer drum, which are at an adjustable distance from an imaginarily generated face of the transfer drum, and which extend over a peripheral region of the transfer drum which is smaller than the peripheral region which extends from the first transfer station of the metal sheets between the first print cylinder and the transfer drum as far as the second transfer station of the metal sheets between the transfer drum and the second print cylinder;

at least one guide element provided at a specific peripheral point on the transfer drum and arranged so that only the rear edge of the respective metal sheets rests against the guide element, which comprises an abutment face for the metal sheets, which is directed outwards and which has a pre-determined angle of inclination with respect to the tangent of the imaginarily generated face of the transfer drum, wherein:

the guide element is mounted so as to be pivotable by means of a pivot bearing with a pivot axis orientated parallel to the axis of the transfer drum, a pivot drive is provided, by means of which the angle of inclination of the abutment face of the guide element can be altered with respect to the tangent of the imaginarily generated face of the transfer drum.

2. A guide device according to claim 1, wherein the angle of inclination between the abutment face and the tangent of the imaginarily generated face of the transfer drum is at least approximately within a range of from 75° to 5°, wherein the larger angular figure is present at that point of the rotational movement of the guide element at which the rear edge of the metal sheets rests against the guide element, and wherein the smaller angular figure is present at that point of the rotational movement of the guide element at which the rear edge of the metal sheets is released from the guide element.

3. A guide device according to claim 1, wherein the abutment face of the guide element is subdivided into two portions, which are arranged adjacent to each other and adjoin each other in an axial direction, and which are inclined in opposite directions in the axial direction, the axial inclination of the two portions of the face is larger or smaller than that displayed by the metal sheets at the contact point with respect to a generating line of the imaginarily generated cylindrical face of the transfer drum.

4. A guide device according to claim 1, wherein the abutment face of the guide element is orientated at an inclination in a axial direction, the inclination of the abutment face in an axial direction is larger or smaller than that displayed by the metal sheets at the contact point with respect to a generating line of the imaginarily generated cylindrical generated face of the transfer drum.

5. A guide device according to claim 1, wherein when two guide elements are present which are arranged at a mutual distance next to each other in an axial direction, their abutment face is also inclined in the axial direction, the inclination of the two abutment faces in an axial direction is orientated in opposite directions, the axial inclination of the two abutment faces is larger or smaller than that displayed by the metal sheets at the contact points with respect to the generating line of the imaginarily generated cylindrical face of the transfer drum.

6. A guide device according to claim 1, wherein in the case of two or more guide elements at least part of the are made adjustable in an axial direction.

7. A guide device according to claim 6, wherein the pivot drive has a pneumatic or hydraulic piston drive or an electromagnet.

8. A guide device according to claim 1, wherein the guide elements and their associated pivot drive are arranged on a common support, which is guided on an arcuate movement path so as to be movable about the axis of the transfer drum, and which is adjustable to a specified peripheral point with respect to a pre-determined fixed point on the transfer drum by means of an adjustment device.

9. A guide device according to claim 1, wherein the pivot drive is adjustable to two end positions.

10. A guide device according to claim 9, wherein the pivot drive has a crank drive or a cam drive or a spindle drive.

11. A guide device according to claim 9 wherein the pivot angle of the guide element is adjustable as a function of at least part of its rotational path between the two peripheral points, at which the rear edge of the metal sheets rests against the guide element, and at which the rear edge of the metal sheets is released from the guide element respectively.

12. A guide device according to claim 1, wherein the pivot drive is continuously adjustable within a predetermined pivoting range.

13. A guide device according to claim 12, wherein the pivot drive is formed by a controllable electric motor or comprises such a motor, the motor comprising one of:

a stepping motor, a servo motor, and a linear motor.

14. A guide device according to claim 1, wherein the guide element is either itself produced from a vibration-damping material, or the guide element is provided with a vibration-damping layer.

15. A guide device according to claim 14, wherein the guide element is provided in the region of its abutment face with a wear-resistant layer.

16. A guide device according to claim 14, wherein the vibration-damping material of the guide element or the vibration-damping layer of the guide element comprising one of:

a plastics material, a solid rubber, and a cellular rubber with open and/or with closed pores.

17. A guide device according to claim 1, wherein the guide element is provided in the region of its abutment face with a wear-resistant layer.

18. A guide device according to claim 17, wherein the wear-resistant layer comprises one of:

a hard metal, an oxide-ceramic material, and a silicate glass.

* * * * *